US007647759B2

(12) United States Patent
Braun et al.

(10) Patent No.: US 7,647,759 B2
(45) Date of Patent: Jan. 19, 2010

(54) METHOD AND DEVICE FOR PROCESSING A WIRE

(75) Inventors: Alfred Braun, Cham (CH); Zane Meredith, Root (CH); Werner Bucher, Dierikon (CH)

(73) Assignee: Komax Holding AG, Dierikon (CH)

( * ) Notice: Subject to any disclaimer, the term of this patent is extended or adjusted under 35 U.S.C. 154(b) by 387 days.

(21) Appl. No.: 11/346,775

(22) Filed: Feb. 3, 2006

(65) Prior Publication Data

US 2006/0179908 A1 Aug. 17, 2006

(30) Foreign Application Priority Data

Feb. 11, 2005 (EP) ..... 05405065

(51) Int. Cl.
*D07B 7/18* (2006.01)

(52) U.S. Cl. ..... 57/2.3; 57/1 UN

(58) Field of Classification Search ..... 57/1 UN, 57/2, 3, 2.3; 140/149; 72/77
See application file for complete search history.

(56) References Cited

U.S. PATENT DOCUMENTS 374,209 A * 12/1887 Sims ..... 57/1 UN
2,714,282 A * 8/1955 Rozieres ..... 57/264
3,866,403 A * 2/1975 Zimmermann, Jr. ..... 57/1 UN
4,428,114 A 1/1984 Teagno
5,169,079 A * 12/1992 Renzetti ..... 242/446
5,477,718 A 12/1995 Sakamoto et al.
5,666,704 A * 9/1997 Price et al. ..... 26/74
5,678,400 A * 10/1997 Heard ..... 57/2.5
5,716,020 A * 2/1998 Shults ..... 242/443
6,167,919 B1 * 1/2001 Fuchsl et al. ..... 140/149
6,401,442 B1 * 6/2002 Root et al. ..... 57/27
6,735,933 B2 * 5/2004 Abba et al. ..... 57/2.3

OTHER PUBLICATIONS http://www.wifi-forum.com/wf/showthread.php?t=4866 Jul. 15, 2004.*

* cited by examiner

*Primary Examiner*—Shaun R Hurley
(74) *Attorney, Agent, or Firm*—Fraser Clemens Martin & Miller LLC; William J. Clemens

(57) ABSTRACT

In a wire-processing device, the wire executes turns through being pulled out of a drum. The leading wire-end is held by a gripper of a loop-former. A wire that has been cut to length is held at its leading and trailing ends by an untwisting unit, the wire having before the untwisting operation a doubled-backed loop. A transfer unit takes the leading and trailing ends from the loop-former and passes the wire to the untwisting unit. After the untwisting operation, the transfer unit feeds the wire-ends to the processing units that process the wire-ends. A bundling unit takes the processed wires from the transfer unit, the bundling unit forming a wire bundle with the wires. With the untwisted wires, the wire bundle has neither doubled-back loops nor knots.

9 Claims, 6 Drawing Sheets

FIG. 14
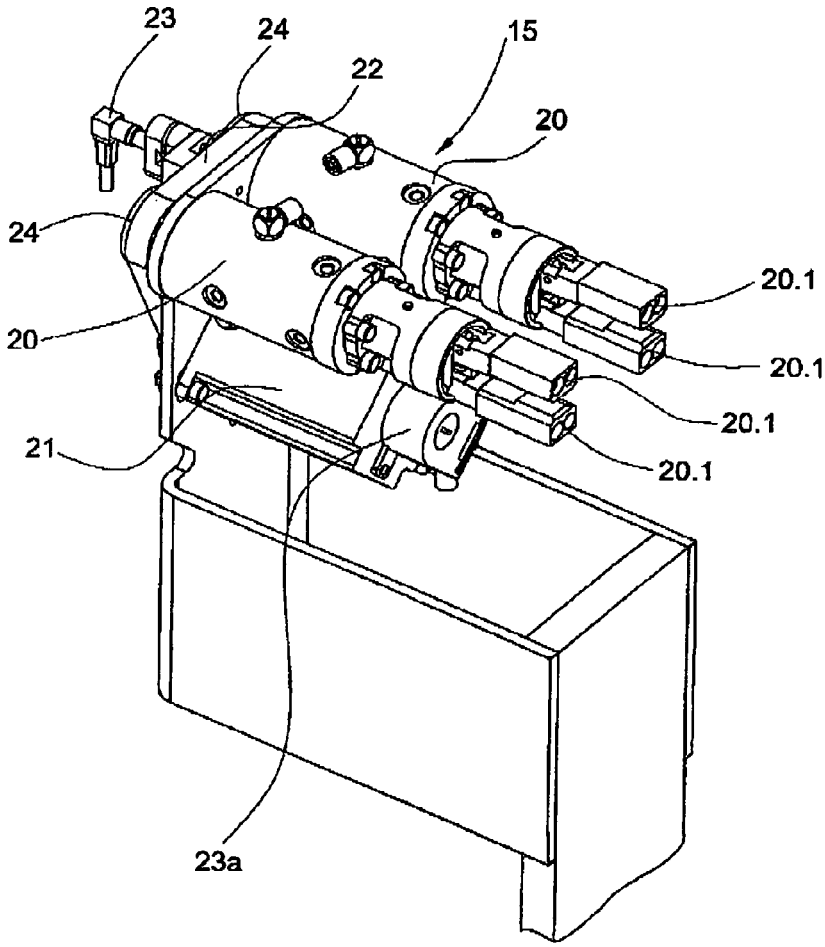
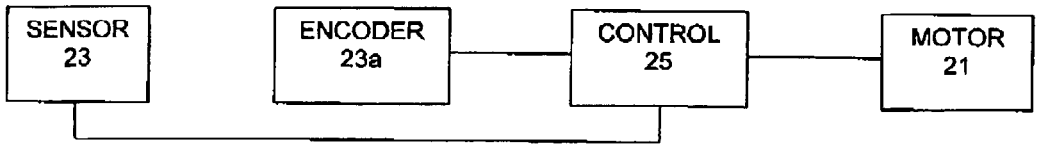
FIG. 15

METHOD AND DEVICE FOR PROCESSING A WIRE

BACKGROUND OF THE INVENTION

The present invention relates to a method and a device for processing a wire that is held at its ends.

After a wire is manufactured, in many cases the wire is fed into a rotating drum. Such a wire drum may contain wire lengths of up to several thousands of meters and can weigh up to about eighty kilograms.

In fully automatic wire-processing, the desired length of wire is pulled out of the top of the non-rotating wire drum by means of grippers and/or belt drives or roller drives.

Normally, wire-processing devices are fed with different types of wire from several wire drums which can be selected and changed according to need by programmed control. Active driving or rotation of the cable drums would be too cost-intensive, especially since different intermittent wire processes would make costly controlled wire stores necessary as compensation (see FIG. 9).

If, when the wire is pulled out of the wire drum, the wire cannot turn or relax into the longitudinal axis of the wire, twist builds up in the wire that depends on the internal and external diameter of the wire drum or on the momentary withdrawal diameter. For example, a 360° drum rotation and a withdrawal diameter of 400 mm results in a 360° twist in a pulled-out length of 1.25 meters assuming constant propagation of twist through the straightening track and the wire advancing device.

During wire advancing and wire-processing, twist is always built up in the wire when each end of the wire is held by grippers. The wire then can not freely untwist or relax by itself about the longitudinal axis of the wire. If only one end of a wire is held by means of grippers, no twist can build up in the longitudinal axis of the wire, and the wire can twist freely around its longitudinal axis while being advanced to length. The twist in the wire manifests itself negatively particularly if the wire-ends are fitted with contacts that are not fitted in housing compartments in a 1:1 sequence. When the wire bundle is stretched, it is easy for knots to form that can only be undone manually (see FIG. 1). Desirable, however, is a wire bundle according to FIG. 2. Even contactless wires of longer length that are taken out of the machine in bundled state tend to twist. The consequence is tangled wire in the wire bundle that also has to be untangled manually.

A wire of strands serving as an electric conductor has a certain number of individual wires and an insulation. In the field of electronics, for example 7 or 19 individual wires of copper are laid with a particular lay (see FIG. 3). Depending on the direction of lay, the lay is called left-hand lay (S-lay) or right-hand lay (Z-lay) (FIGS. 4 and 5).

Because of the special construction of a 19-strand wire, there are several different possible ways of laying (see FIGS. 6 and 7), four types being typical:

a) same direction of lay/same length of lay (unilay concentric);

b) same direction of lay/different length of lay (unidirectional concentric);

c) different direction of lay/same length of lay (equilay concentric); and d) different direction of lay/different length of lay (conventional concentric).

After laying, by means of an extruder the wire is covered with an insulation which can be of greatly varying hardness and thickness depending on need.

If a wire with the aforesaid characteristics is now pulled through a straightening track of a wire-processing machine, the tensions of the individual wire strands can change and thereby greatly affect the overall twist (drum, wire) as a result of overlaying.

SUMMARY OF THE INVENTION

The present invention provides a remedy to and avoids the disadvantages of the known machines with a method and a device that counteract the formation of twist in a wire.

The advantages achieved by the present invention are mainly that with the manufacture of wire bundles without doubled-back loops, the production time especially for subsequent processing processes can be substantially reduced. Furthermore, only with twist-free wire-processing processes, do for example wire connections manufactured by ultrasonic methods become possible. Cable bundles that do not need to be untangled manually after they have been manufactured are of higher quality since the individual wires have no kinks or knots and can therefore be better laid. Furthermore, with mechanical removal of the wire twist, wire bundles that are free of doubled-back loops can always be guaranteed.

DESCRIPTION OF THE DRAWINGS

The above, as well as other, advantages of the present invention will become readily apparent to those skilled in the art from the following detailed description of a preferred embodiment when considered in the light of the accompanying drawings in which:

FIG. 14 is an enlarged fragmentary view of an untwisting unit of the apparatus shown in FIG. 9; and FIG. 15 is a block diagram of the control for the untwisting unit shown in FIG. 9.

DESCRIPTION OF THE PREFERRED EMBODIMENT

Figure 1:
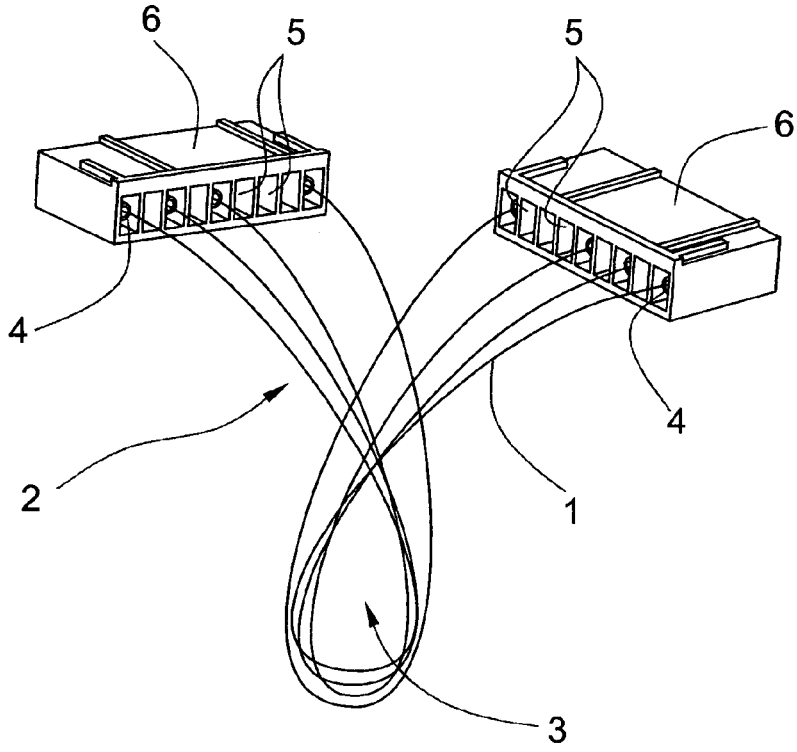
FIG. 1 is a perspective view of a wire bundle with doubled-back loops caused by wire twist.
Figure 2:
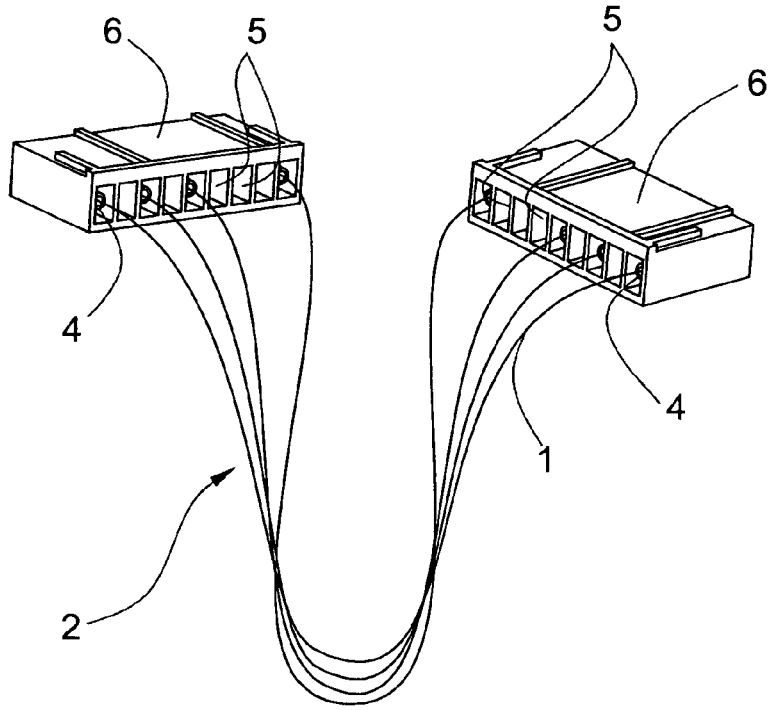
FIG. 2 is a perspective view of the wire bundle with untwisted wires.

FIG. 1 shows a wire bundle 2 comprising several wires 1 with doubled-back loops 3 caused by wire twist. Arranged on the wire-ends are, for example, are contacts 4 engaging compartments 5 of connector housings 6. While being processed (having its end cut off, insulation stripped, bush mounted, contact crimped, etc.) each wire 1 is held at both wire-ends 1.1 (FIG. 8) so that in the manner described above the twist could not relax and cause the doubled-back loops 3. FIG. 2 shows the wire bundle 2 with untwisted wires 1 and with no doubled-back loops 3. After the wires 1 have been cut to length, they are mechanically untwisted around their longitudinal axis and can therefore not form any further doubled-back loops 3.

Figure 3:
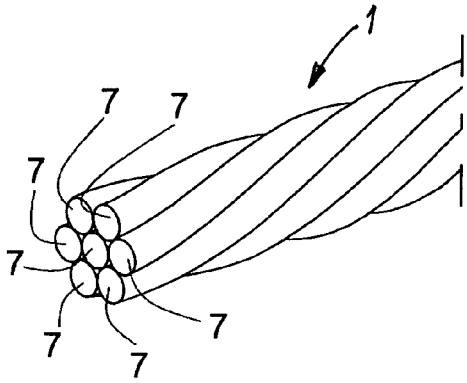
FIG. 3 is a perspective view of an end of a stripped wire with laid strands as electric conductors.
Figure 4:
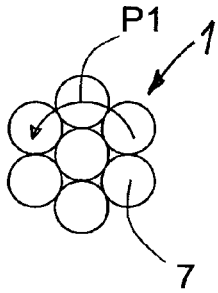
FIG. 4 is schematic end view of a wire with strands laid in left-hand lay.
Figure 5:
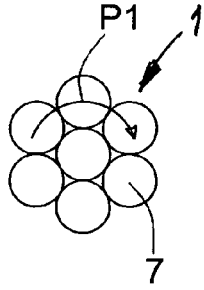
FIG. 5 is a view similar to FIG. 4 of a wire with strands laid in right-hand lay.
Figure 6:
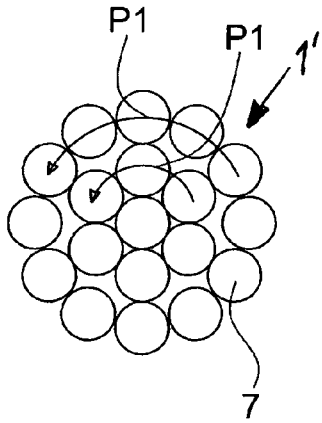
FIGS. 6 and 7 are views similar to FIG. 4 with wires laid with left-hand and right-hand lay.
Figure 7:
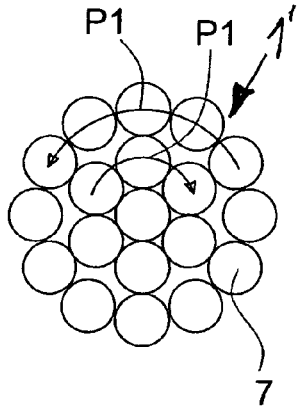

FIGS. 3 to 7 show the stripped wire 1 with laid strands 7 as electric conductors and their lay. FIGS. 3 to 5 show the wire 1 with seven of the strands 7. FIGS. 6 and 7 show a wire 1' with nineteen of the strands 7. The type of lay (left-hand or right-hand lay) is represented by an arrow P1.

Figure 8:
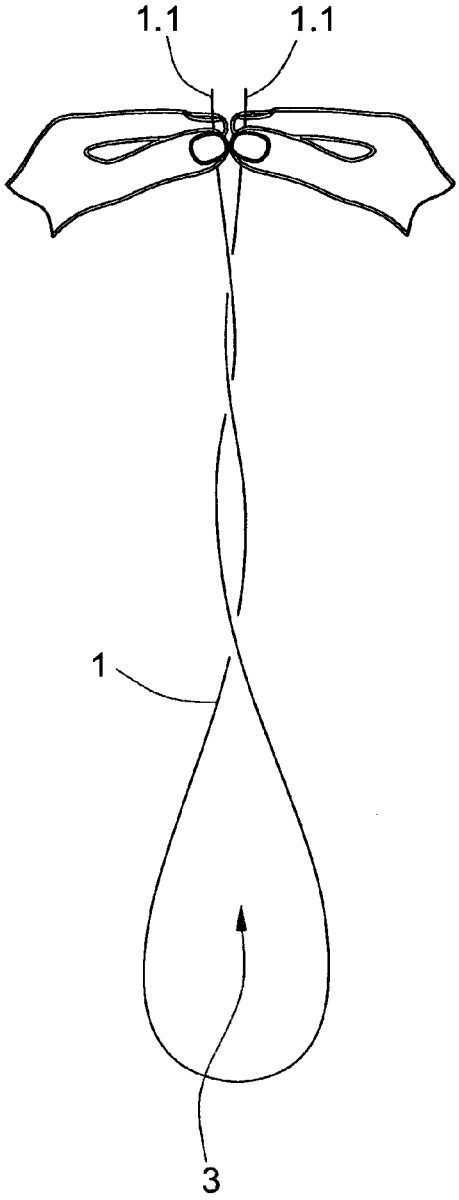
FIG. 8 is an illustration of a method of determining the twist in the wire.

FIG. 8 shows a method for determining the twist in the wire 1. When manufacturing a wire bundle, the twist of the wire 1 (twisting of the wire about its longitudinal axis) is significant. Determination of the twist takes place most easily as shown in FIG. 8. After the wire in the wire-processing apparatus has been advanced to the desired length, the wire 1 is manually removed from the grippers of, for example, a transfer unit 16 (FIG. 9), without the wire 1 being able to twist or untwist (relax) in its starting position. The two wire-ends 1.1 are brought together, the wire 1 causing through its twist several doubled-back loops 3. The direction of twist depends heavily on the direction of lay of the individual wires. The number of doubled-back loops 3 (in FIG. 8 the wire 1 with a length of two meters has three loops) is a measure of the untwisting.

The example according to FIG. 8 with a wire length of two meters and three loops 3 that double-back in counterclockwise direction (looking onto the wire-ends 1.1) results in a twist mass dm=2 m/3 loops≈0.7 m/loop. This value, along with the associated direction of twist (clockwise/counterclockwise), can be determined for each type of wire and saved by means of the wire-processing control. As a result of the twist mass and the twist direction, an untwisting unit 15 (FIG. 9) completes the necessary number of turns in the opposite direction to the twist (untwisting direction). The untwisting unit 15, as shown in FIG. 14, has two rotating grippers 20, each with two gripper ends 20.1, that execute rotations in a clockwise direction (looking onto the wire-ends 1.1). In this manner, the wire 1 is turned clockwise (looking onto the wire ends 1.1) by a total of three times (twice 1.5 turns) about its own longitudinal axis.

Figure 9:
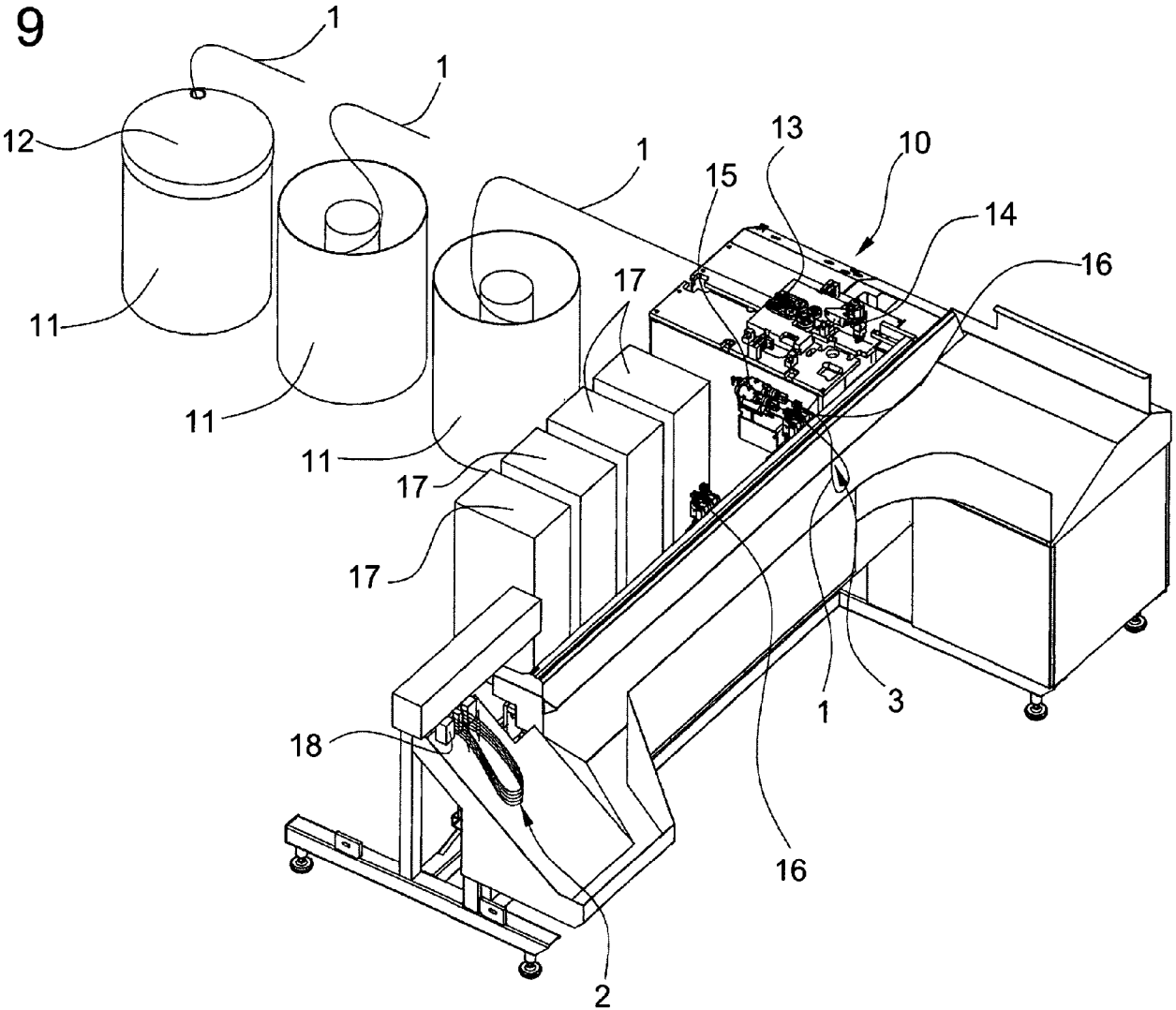
FIG. 9 is a perspective view of a wire-processing apparatus.

FIG. 9 shows a wire-processing apparatus 10. For greater clarity, a wire changer, a straightening track, a cutting unit, and a stripping unit are not shown. When being withdrawn from a drum 11, the wire 1 executes turns in a clockwise or a counterclockwise direction. Drum covers 12 prevent swinging out over the side of the drum. Via not-shown diverters (rollers or eyes of a frame) the wire passes via wire changers through the straightening track to a wire advancing unit 13. The advancing wire-end is held by a gripper of a loop-former 14. The transfer unit 16 takes the leading wire-end and the trailing wire-end from the loop-former 14 and passes them to the untwisting unit 15. The wire 1 that has been cut to length is held by the untwisting unit 15 at the leading end and at the trailing end, the wire 1 having before the untwisting operation the doubled-back loop 3. The untwisting unit 15 can be placed instead of a handover unit. After the untwisting operation, the transfer unit 16 takes the leading wire-end and the trailing wire-end from the untwisting unit 15 and feeds the wire-ends to processing units 17 which process the wire-ends (strip, fit bushes, crimp contacts, etc.). Provided after the processing unit 17 is a bundling unit 18 which takes the processed wire 1 from the transfer unit 16, the bundling unit 18 forming the wire bundle 2 with the wires 1. Instead of the bundling unit 18, a fitting unit for fitting the connector housings 6, for example, can be provided. With the untwisted wires 1, the wire bundle 2 has neither doubled-back loops nor knots.

Figure 10:
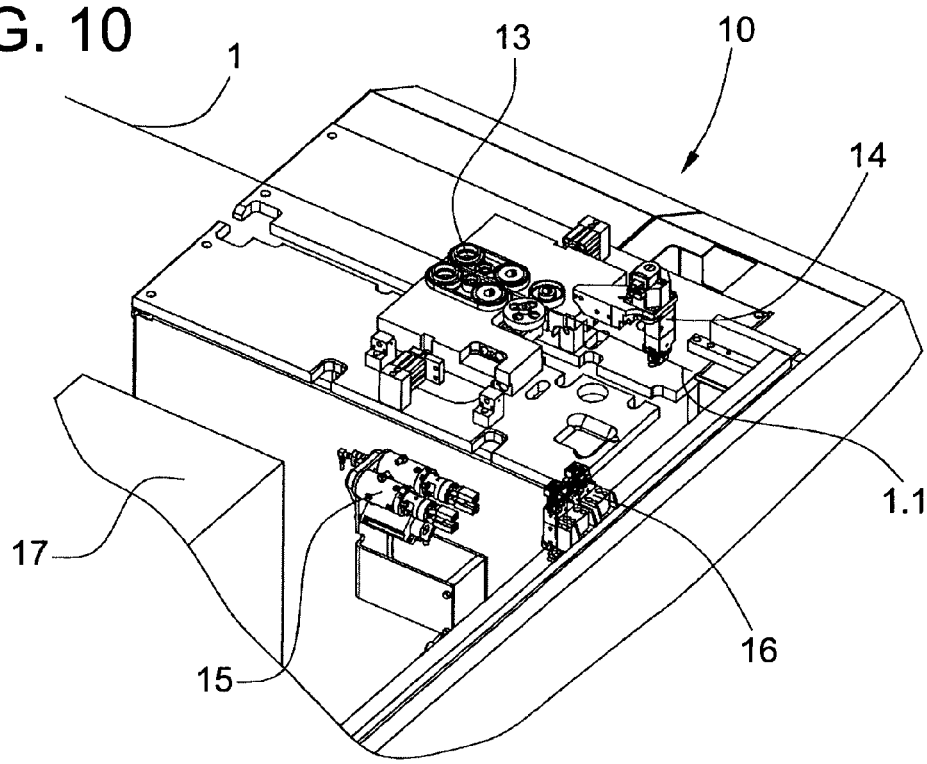
FIGS. 10 to 13 are enlarged fragmentary views of a portion of the apparatus shown in FIG. 9 for a cuffing the end off and untwisting a wire.
Figure 11:
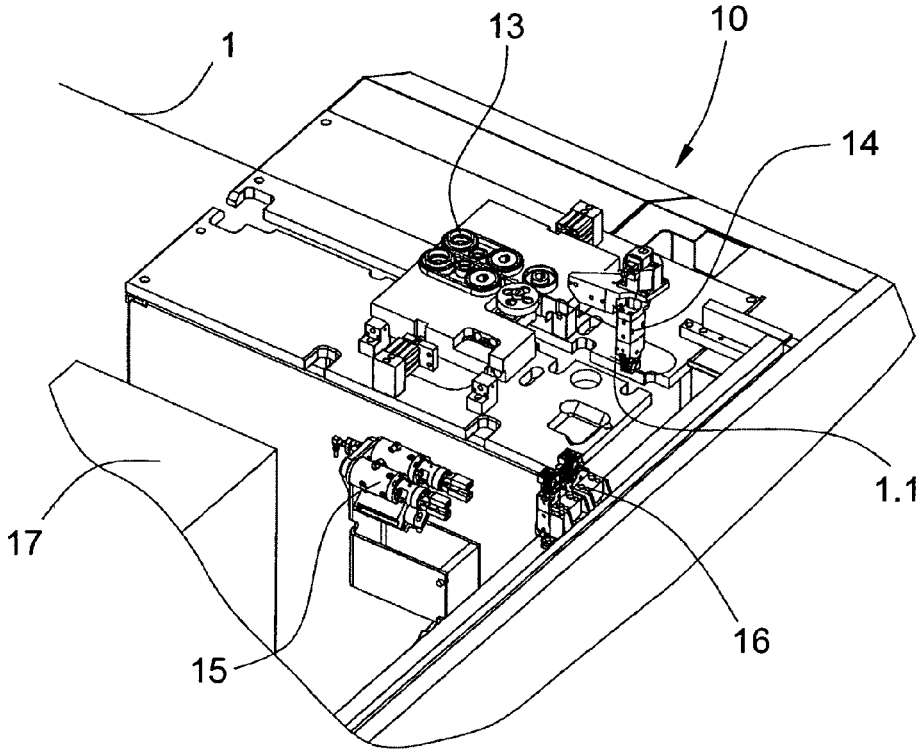
Figure 12:
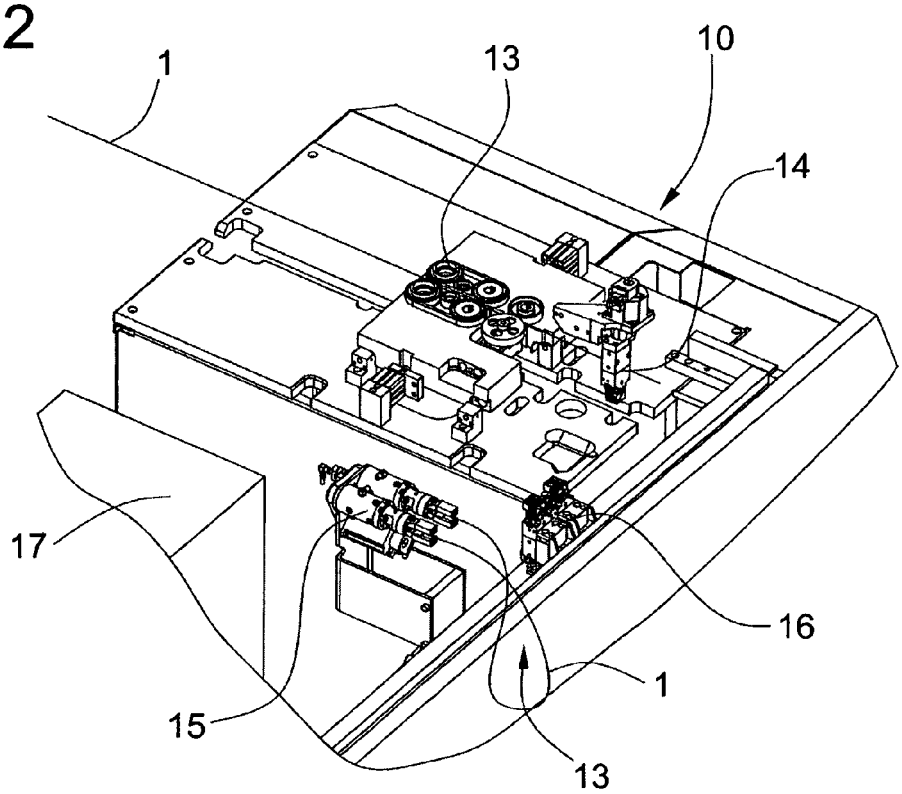
Figure 13:
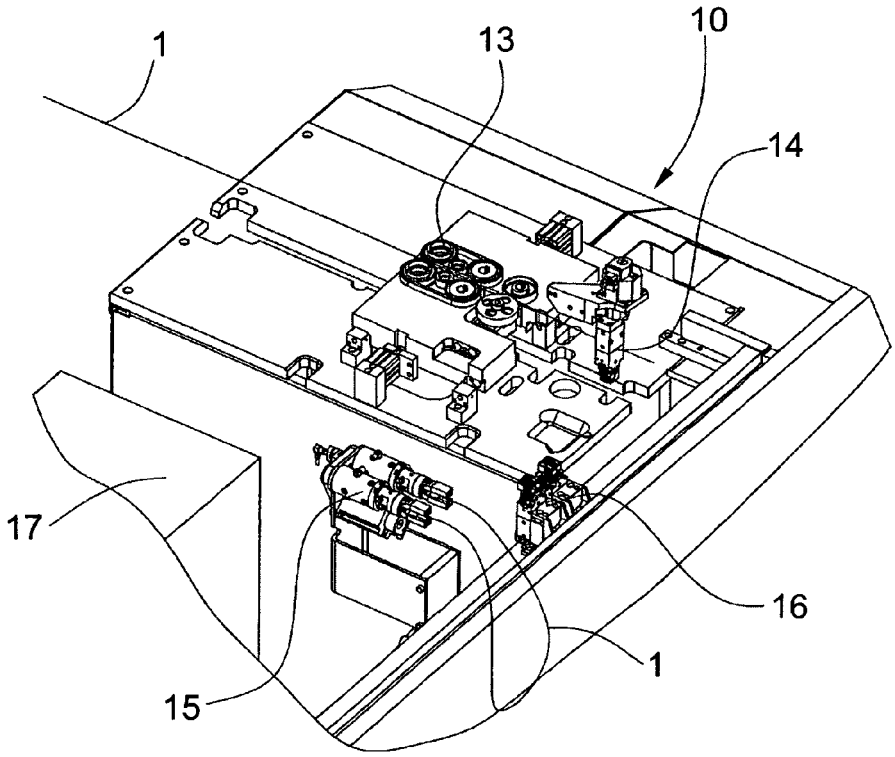

FIGS. 10 to 13 show the cutting to length and untwisting of the wire 1. In FIG. 10, the leading end of the wire 1 is grasped by the loop-former 14. As shown in FIG. 11, at the start of the wire advance, the loop-former 14 executes a 180° swivel movement with the leading wire-end. After advance of the wire, the transfer unit 16 takes both wire-ends 1.1 of the wire 1. The wire 1 is then separated from the drum-side wire and transported to the untwisting unit 15 which thereby releases the wire along the longitudinal axis of the wire and therefore also the doubled-back loop (FIGS. 12 and 13).

FIG. 14 shows the untwisting unit 15 with the two motor-driven rotating grippers 20 for both ends 1.1 of the wire 1. By means of a toothed belt 22, a motor 21 drives pulleys 24 of the rotating grippers 20, the number of rotations being monitored by a sensor 23. Arranged on the pulley 24 is, for example, a metal mark that can be detected by the sensor 23. On detection of the metal mark by the sensor 23, the gripper ends 20.1 are in the position shown in FIG. 14 in which the wire 1 can be fed or transported further without restriction. The position of the gripper ends 20.1 can also be determined after initialization by means of the encoder signals of a motor encoder 23*a*. Advantageously, before and after the untwisting operation, the gripper ends 20.1 are turned into the position shown, the wire 1 being feedable or further transportable without additional movements. After the wire-ends have been taken by the transfer unit 16, the gripper ends 20.1 are opened and the wire can be linearly transported further. Tests have shown that the sufficient number of rotations determined about the longitudinal axis of the wire to untwist the wire 1 is ±½ rotation.

In the example according to FIG. 14, the gripper ends 20.1 are closed together pneumatically and opened by spring force (Double-acting pneumatic device per gripper 20). A single-acting pneumatic device is also possible in which the gripper ends 20.1 are closed pneumatically and opened by spring force. FIG. 15 shows the wire-processing device control 25 connected to receive signals from the sensor 23 and the encoder 23*a* and to generate a signal to actuate the motor 21 to rotate the grippers 20. The control 25 also saves the twist mass value and the direction of the twist as stated above.

As a variant embodiment, the untwisting unit 15 can be provided with only one of the rotating grippers 20, this requiring double the amount of time for untwisting, and the second wire-end needing to be gripped tightly during this time. (In the example of FIG. 8, the gripper of the individual rotating grippers must execute three revolutions in counterclockwise direction.) Similar operation applies to linear machines with oppositely positioned wire-ends; correspondingly only one untwisting unit with one rotating gripper is required here.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A device in a wire processing apparatus for processing a continuous wire that is held at its opposite ends to remove a twist present in the wire comprising:

a pair of grippers each having gripper ends holding an associated opposite end of the twisted continuous wire, said gripper ends of at least one of said grippers being rotatable for turning the associated wire end about a longitudinal axis of the wire until the wire is untwisted; and a motor driving said gripper ends of said at least one gripper in rotation.

2. The device according to claim 1 wherein said gripper ends of each said gripper holding an associated end of the wire executes half of the turns necessary for untwisting the wire.

3. The device according to claim 1 including a sensor for monitoring a number of rotations of said gripper ends of said at least one gripper.

4. The device according to claim 3 wherein said sensor detects a position of said gripper ends of said at least one gripper before turning.

5. The device according to claim 1 wherein said motor drives said gripper ends of said at least one gripper through a belt and pulley.

6. The device according to claim 1 including a motor encoder for sensing rotation of said motor.

7. The device according to claim 1 including determining a twist mass dm=wire length/number of loops and the direction of twist for each wire type to be processed and saving the twist dimension and direction of twist in a wire-processing device control.

8. The device according to claim 7 wherein the number of turns for untwisting the wire corresponds to a number of doubled-back loops in the wire and the direction of untwisting is opposite to a direction of twist of the wire.

9. A device in a wire processing apparatus for processing a continuous wire that is held at its opposite ends to remove a twist present in the wire comprising:

a pair of grippers each having gripper ends holding an associated opposite end of the twisted continuous wire, said gripper ends being rotatable for turning the associated wire end about a longitudinal axis of the wire until the wire is untwisted;

a motor driving said gripper ends of said at least one gripper in rotation;

a sensor for monitoring a number of rotations of said gripper ends and for detecting a position of said gripper ends before turning; and a control for controlling the rotation of said motor in response to a signal from said sensor.

* * * * *